US009738067B2

(12) United States Patent
Misawa et al.

(10) Patent No.: US 9,738,067 B2
(45) Date of Patent: Aug. 22, 2017

(54) LIQUID INJECTION DEVICE AND INKJET RECORDING DEVICE INCLUDING THE SAME

(71) Applicant: Roland DG Corporation, Hamamatsu-shi, Shizuoka (JP)

(72) Inventors: Keisuke Misawa, Hamamatsu (JP); Takashi Makinose, Hamamatsu (JP); Kenji Kawagoe, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/374,045

(22) Filed: Dec. 9, 2016

(65) Prior Publication Data

US 2017/0165965 A1 Jun. 15, 2017

(30) Foreign Application Priority Data

Dec. 11, 2015 (JP) ..... 2015-242590

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04541; B41J 2/04581
See application file for complete search history.

(56) References Cited

U.S. PATENT DOCUMENTS 6,127,159 A * 10/2000 Fuller ..... C12Y 301/05001 424/94.1
6,331,040 B1 * 12/2001 Yonekubo ..... G06K 15/102 347/15
6,382,753 B1 * 5/2002 Teramae ..... B41J 2/04541 347/10
2014/0240384 A1 8/2014 Yokomaku

FOREIGN PATENT DOCUMENTS

EP 0 738 602 A2 10/1996
JP 05-193127 A 8/1993
JP 09-52360 A 2/1997
JP 10-024570 A 1/1998
(Continued)

*Primary Examiner* — Lamson Nguyen
(74) *Attorney, Agent, or Firm* — Keating & Bennett, LLP

(57) ABSTRACT

A liquid injection device includes a liquid injection head and a controller that generates a driving signal including first through fourth driving pulses in one liquid drop injection period and supplies the driving signal to the liquid injection head. The discharge time period of each of the first and second driving pulses is preferably set to about (½)×Tc. The start timing of the second driving pulse is preferably set to about m×Tc (m≥1) after the start of the first driving pulse. The second ink drop is preferably set to be injected at a speed of the first ink drop or higher. The start timing of the third driving pulse is preferably set to about (n+(½))×Tc (n≥1) after the start of the second driving pulse. The start timing of the fourth driving pulse is preferably set to about p×Tc (p≥2) after the start of the third driving pulse. The fourth ink drop is injected at a speed of the third ink drop or higher.

12 Claims, 8 Drawing Sheets

(56) References Cited

FOREIGN PATENT DOCUMENTS

| | | | |
|---|---|---|---|
| JP | 10-081012 | A | 3/1998 |
| JP | 2001-191526 | A | 7/2001 |
| JP | 2002-225253 | A | 8/2002 |
| JP | 3389859 | B2 | 3/2003 |
| JP | 2008-062548 | A | 3/2008 |
| JP | 2014-162221 | A | 9/2014 |

* cited by examiner

LIQUID INJECTION DEVICE AND INKJET RECORDING DEVICE INCLUDING THE SAME

CROSS REFERENCE TO RELATED APPLICATIONS

This application claims the benefit of priority to Japanese Patent Application No. 2015-242590 filed on Dec. 11, 2015. The entire contents of this application are hereby incorporated herein by reference.

BACKGROUND OF THE INVENTION

1. Field of the Invention

The present invention relates to a liquid injection device and an inkjet recording device including the same, and more specifically, to a control technology for liquid injection adopting a so-called multi-dot system.

2. Description of the Related Art

A liquid injection device used for an inkjet recording device or the like includes a liquid injection head injecting a liquid drop and a control device controlling the liquid injection head. For example, an ink injection head in an inkjet recording device includes a pressure chamber temporarily storing ink, an actuator that is in contact with the pressure chamber and includes a piezoelectric element, and a nozzle that is in communication with the pressure chamber and injects an ink drop toward a recording medium such as a recording paper sheet or the like. Such an inkjet recording device is operated as follows. When a driving pulse is transmitted to the actuator, the piezoelectric element is contracted or extended based on the driving pulse. As a result, the interior of the pressure chamber is expanded or contracted to inject ink in the pressure chamber from the nozzle. The injected ink drop lands on the recording medium, and thus one dot (drop corresponding to one pixel) is formed on the recording medium.

In such an inkjet recording device, there is a limit on the amount of liquid contained in one liquid drop that can be stably injectable by one driving pulse. Thus, various studies have been made conventionally in order to realize gray scale printing. For example, Japanese Laid-Open Patent Publication No. 2014-162221 discloses a method for driving an ink injection head by which the size of dots is adjusted by a multi-dot system. By the multi-dot system, a driving signal including a plurality of driving pulses in one liquid drop injection period for forming one dot is generated. From the plurality of driving pulses, one or at least two driving pulses are selected in accordance with the size of the dot, and are supplied to the actuator driving the ink injection head. For example, for forming a relatively large dot, two or more ink drops are injected in a time-series manner in one liquid drop injection period. These ink drops are merged before landing on the recording medium, or are caused to land on the same position on the recording medium.

SUMMARY OF THE INVENTION

According to studies performed by the present inventors, there is still room for improvements in applying the above-described structure to, for example, a large printer for industrial use. As compared with a printer for home use, a large printer needs to form a larger dot (e.g., a dot having a mass of about 15 ng or greater) at a higher printing speed. However, if the printing gap is increased in order to inject a larger ink drop or if the driving frequency is increased in order to print at a higher speed, the ink injection tends to be destabilized. When a large liquid drop is injected from a nozzle, a so-called overflow of a meniscus occurs, which may result in the ink being attached to a nozzle opening or a vicinity thereof. This may cause unevenness or deviation in the distribution of the wettability at, or in a vicinity of, the nozzle. As a result, the ink drop to be injected next may be curved while jumping, which decreases image quality.

Preferred embodiments of the present invention provide a liquid injecting device injecting a liquid drop of a predetermined size stably. Preferred embodiments of the present invention also provide an inkjet recording device including the liquid injection device.

A liquid injection device according to a preferred embodiment of the present invention includes a liquid injection head injecting a liquid drop; and a controller controlling the liquid injection head. The liquid injection head includes a hollow case main body provided with an opening; a vibration plate attached to the case main body so as to cover the opening, the vibration plate defining a pressure chamber together with the case main body; a pressure generator coupled with the vibration plate and located to expand and contract the pressure chamber; and a nozzle provided in the case main body so as to be in communication with the pressure chamber, the nozzle allowing a liquid to flow out therefrom. The controller includes a driving signal generator generating a driving signal including, in one liquid drop injection period, a first driving pulse to expand and contract the pressure chamber to inject a first liquid drop, a second driving pulse to expand and contract the pressure chamber to inject a second liquid drop; a third driving pulse to expand and contract the pressure chamber to inject a third liquid drop, and a fourth driving pulse to expand and contract the pressure chamber to inject a fourth liquid drop; and a driving signal supplier supplying the driving signal to the pressure generator of the liquid injection head. Tc is a Helmholtz characteristic vibration period of the liquid injection head. The first driving pulse maintains the pressure chamber in an expanded state for a time period of about $(1/2)\times Tc$; the second driving pulse starts at a timing that is about $m\times Tc$ after the start of the first driving pulse, m being an integer of 1 or greater, to maintain the pressure chamber in the expanded state for the time period of about $(1/2)\times Tc$, and to inject the second liquid drop at a speed higher than, or equal to, a speed at which the first liquid drop is injected; the third driving pulse starts at a timing that is about $(n+(1/2))\times Tc$ after a start of the second driving pulse, n being an integer of 1 or greater; and the fourth driving pulse starts at a timing that is about $p\times Tc$ after a start of the third driving pulse, p being an integer of 2 or greater, and to inject the fourth liquid drop at a speed higher than, or equal to, a speed at which the third liquid drop is injected.

In the above-described liquid injection device, a plurality of liquid drops are merged together to form one large dot stably. This will be described in detail. The first driving pulse and the second driving pulse each switch the pressure chamber from an expanded state to a contracted state at a timing that preferably is about $(1/2)\times Tc$ after the start of the corresponding driving pulse, for example. Thus, each of the driving pulses acts to amplify the Helmholtz characteristic vibration. As a result, the injection stability of the liquid drop is increased, and the expansion and contraction amount of the pressure chamber is increased. Thus, a larger liquid drop is injected. The timing at which the second driving pulse starts is preferably set to about $m\times Tc$ ($m\geq 1$) after the start of the first driving pulse. This further amplifies the vibration of the pressure chamber amplified by the first driving pulse, and thus the second liquid drop is injected stably. In addition, the second liquid drop is injected at a speed higher than, or equal to, the speed at which the first liquid drop is injected. This allows the first liquid drop and the second liquid drop to merge together appropriately. Since the speed at which the second liquid drop is injected is increased, a satellite after the injection of the first liquid drop is absorbed, and thus generation of mist is suppressed or prevented.

In addition, the timing at which the third driving pulse starts is preferably set to about $(n+(1/2))\times Tc$ ($n\geq 1$) after the start of the second driving pulse. With such a setting, the third ink drop is injected at a low speed and thus is injected while being separated from the first ink drop and the second ink drop already injected. This prevents the ink from being attached to a nozzle opening or a vicinity thereof, and improves the injection stability and the precision of the landing position. The timing at which the fourth driving pulse starts is preferably set to about $p\times Tc$ ($p\geq 2$) after the start of the third driving pulse. With such a setting, the fourth ink drop is stably injected as a large ink drop to improve the injection stability. Since the fourth ink drop is injected at a speed higher than, or equal to, the speed at which the third ink drop is injected, the third ink drop and the fourth ink drop are merged together properly. For the above-described reasons, the liquid injection device injects a liquid drop of a desired size even for, for example, forming a large dot at high speed driving.

In another aspect of a preferred embodiment of the present invention, an inkjet recording device including the above-described liquid injection device is provided. The inkjet recording device forms even a dot of a large size stably by a multi-dot system. Therefore, for example, the variance in the dot diameter or the position at which the liquid drop lands is decreased, and thus the printing quality is improved. The stain on the recording medium or the main body of each of the devices caused by the satellite drop or mist is alleviated.

Liquid injection devices according to a preferred embodiment of the present invention stably inject a liquid drop of a desired size by a multi-dot system. Therefore, the injection stability of, for example, a large liquid drop is improved.

The above and other elements, features, steps, characteristics and advantages of the present invention will become more apparent from the following detailed description of the preferred embodiments with reference to the attached drawings.

DESCRIPTION OF THE PREFERRED EMBODIMENTS

Hereinafter, liquid injection devices and inkjet recording devices according to preferred embodiments of the present invention will be described with reference to the drawings. The preferred embodiments described herein do not limit the present invention in any way. Components or portions having the same function will bear the same reference signs, and overlapping descriptions will be omitted or simplified.

Figure 1:
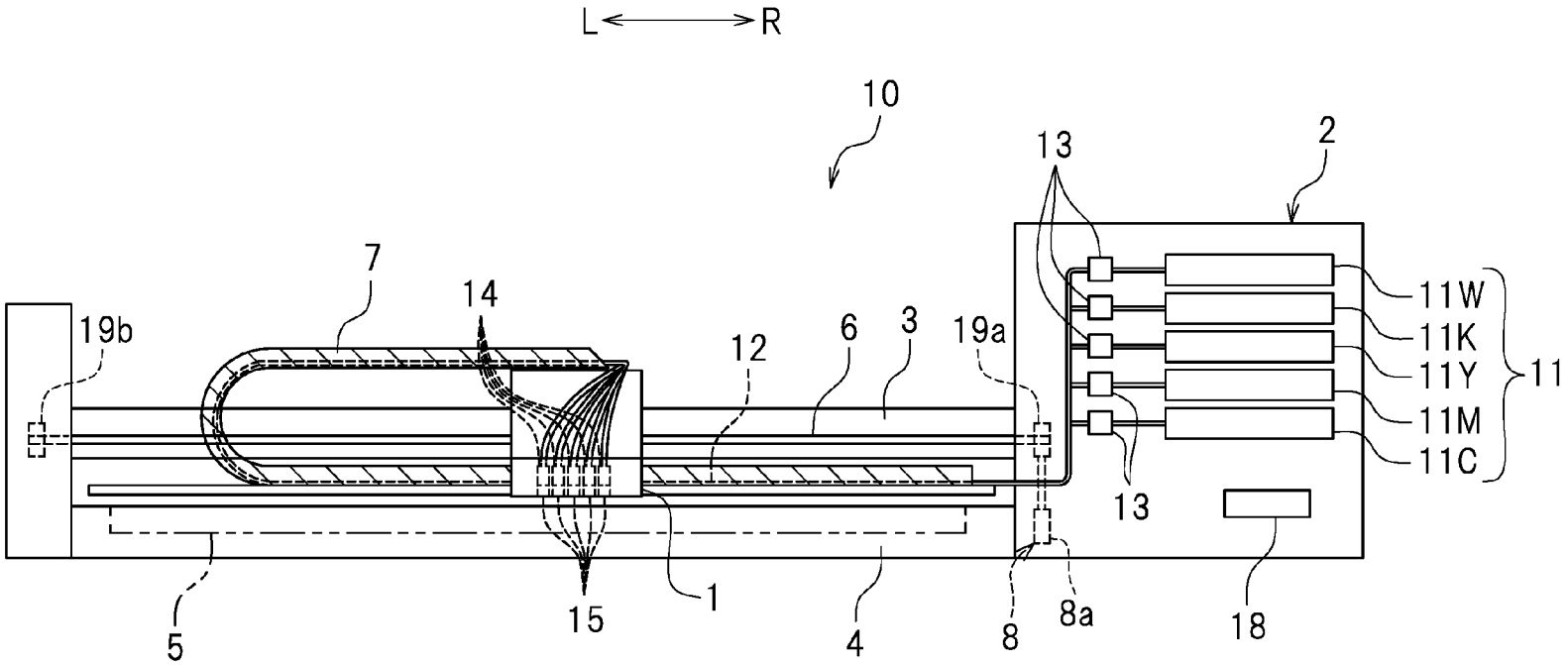
FIG. 1 is a front view of an inkjet printer according to a preferred embodiment of the present invention.

First, an inkjet recording device will be described. FIG. 1 is a front view of a large inkjet printer (hereinafter, referred to as the "printer") 10 according to a preferred embodiment of the present invention. The printer 10 is an example of an inkjet recording device. In FIG. 1 and the like, the letters "L" and "R" respectively refer to left and right. In FIG. 1, the side closer to the viewer of FIG. 1 and the side farther from the viewer of FIG. 1 are respectively the front side and the rear side. It should be noted that these directions are defined merely for the sake of convenience, and do not limit the manner of installation of the printer 10 in any way.

The printer 10 is to perform printing on a recording paper sheet 5, which is a recording medium. The "recording medium" encompasses recording mediums formed of paper including plain paper and the like, resin materials including polyvinyl chloride (PVC), polyester and the like, and various other materials including aluminum, iron, wood and the like.

The printer 10 includes a printer main body 2, and a guide rail 3 secured to the printer main body 2. The guide rail 3 extends in a left-right direction. The guide rail 3 is in engagement with a carriage 1 provided with damper devices 14 and ink injection heads 15. The carriage 1 moves reciprocally in the left-right direction (scanning direction) along the guide rail 3 by a carriage moving mechanism 8. The carriage moving mechanism 8 includes rollers 19*a* and 19*b* provided at a right end and a left end of the guide rail 3. The roller 19*a* is coupled with a carriage motor 8*a*. The carriage motor 8*a* may be coupled with the roller 19*b*. The roller 19*a* is driven to rotate by the carriage motor 8*a*. An endless belt 6 extends along, and between, the rollers 19*a* and 19*b*. The carriage 1 is secured to the endless belt 6. When the rollers 19*a* and 19*b* are rotated and thus the belt 6 runs, the carriage 1 moves in the left-right direction.

The printer 10 preferably is larger than, for example, a table-top printer for home use. For the printer 10, the scanning speed of the carriage 1 may be occasionally set to be relatively high from the point of view of increasing the throughput although the scanning speed is set also in consideration of resolution. For example, the scanning speed may be preferably set to about 600 mm/s to about 900 mm/s when the driving frequency is about 14 kHz. For higher-speed operation, the scanning speed may be set to about 1000 mm/s or greater, for example, about 1100 mm/s to about 1200 mm/s, when the driving frequency is about 20 kHz. In such a case, the interval between injections of ink drops is significantly short. Therefore, the technology disclosed herein is especially effective for the printer 10.

The printing paper sheet 5 is transported in a paper feeding direction by a paper feeding mechanism (not shown). In this example, the paper feeding direction is a front-rear direction. The printer main body 2 includes a platen 4 supporting the recording paper sheet 5. The platen 4 includes a grid roller (not shown). A pinch roller (not shown) is provided above the grid roller. The grid roller is coupled with a feed motor (not shown). The grid roller is driven to rotate by the feed motor. When the grid roller is rotated in a state where the recording paper sheet 5 is held between the grid roller and the pinch roller, the recording paper sheet 5 is transported in the front-rear direction.

The printer main body 2 is provided with an ink cartridge 11. The ink cartridge 11 is a tank storing ink. In the preferred embodiment shown in FIG. 1, a plurality of ink cartridges 11C, 11M, 11Y, 11K and 11W are detachably attached to the printer main body 2. The ink cartridge 11C stores cyan ink. The ink cartridge 11M stores magenta ink. The ink cartridge 11Y stores yellow ink. The ink cartridge 11K stores black ink. The ink cartridge 11W stores white ink.

The printer 10 includes an ink supply system for each of the ink cartridges 11C, 11M, 11Y, 11K and 11W of the respective colors. Hereinafter, a structure of the ink supply system provided for the ink cartridge 11C will be specifically explained as an example. The ink supply system for the ink cartridge 11C includes an ink supply path 12, a liquid transmission pump 13, the damper device 14, the ink injection head 15, and a controller 18. The ink supply path 12 is an ink flow path guiding the ink from the ink cartridge 11C to the ink injection head 15. The ink supply path 12 is, for example, a resin deformable tube. The liquid transmission pump 13 is an example of a liquid transmission device that supplies the ink from the ink cartridge 11C toward the ink injection head 15. The liquid transmission pump 13 is provided on the ink supply path 12. The liquid transmission pump 13 is a so-called tube pump of, for example, a trochoid pump system. The liquid transmission pump 13 is connected with the controller 18. The damper device 14 is in communication with the ink injection head 15, and supplements the ink supplied to the ink injection head 15. The damper device 14 also alleviates the pressure fluctuation of the ink to stabilize the ink injection operation of the ink injection head 15.

The damper device 14 and the ink injection head 15 are mounted on the carriage 1, and move in the left-right direction. By contrast, the ink cartridge 11C is not mounted on the carriage 1, and does not reciprocally move in the left-right direction. A majority of the ink supply path 12 extends in the left-right direction so as not to be broken even when the carriage 1 moves in the left-right direction. In this preferred embodiment, five types of ink preferably are used, and therefore, a total of five ink supply paths 12 are provided, for example. The ink supply paths 12 are covered with a cable protection and guide device 7. The cable protection and guide device 7 is, for example, a cableveyor (registered trademark).

Figure 2:
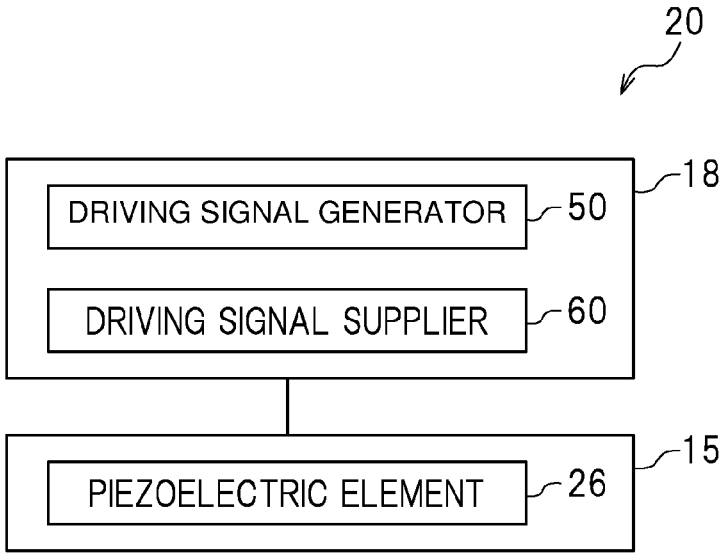
FIG. 2 is a block diagram showing a structure of an ink injection device.

The printer 10 includes an ink injection device 20 as an ink injection mechanism. FIG. 2 is a block diagram showing a structure of the ink injection device 20. The ink injection device 20 includes the ink injection head 15 injecting the ink and the controller 18 controlling an operation of the ink injection head 15.

The ink injection head 15 is to perform printing on the recording paper sheet 5. Specifically, the ink injection head 15 is to inject an ink drop having a predetermined size toward the recording paper sheet 5 to form a dot on the recording paper sheet 5. The ink injection head 15 includes a plurality of nozzles 25 (see FIG. 3) injecting ink. The nozzles 25 are provided on a surface of the ink injection head 15 that faces the recording paper sheet 5. The plurality of nozzles 25 are arrayed at a predetermined pitch corresponding to the dot formation density (for example, arrayed at 360 dpi). The ink injection head 15 is an example of a liquid injection head.

Figure 3:
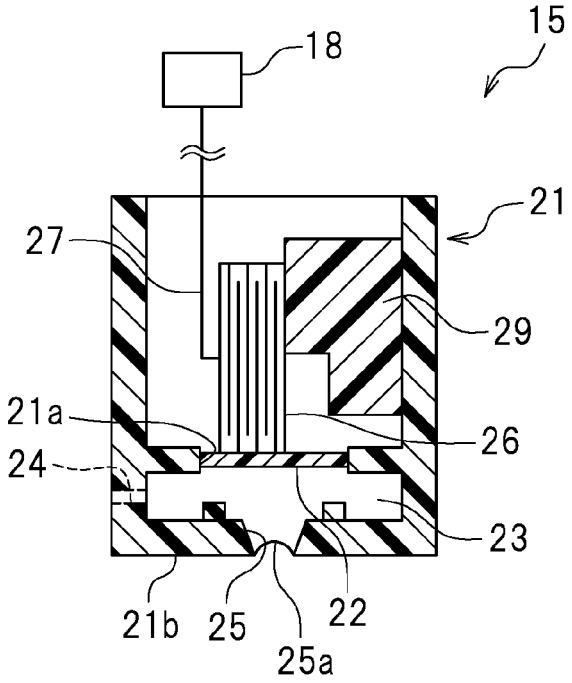
FIG. 3 is a partial cross-sectional view of a nozzle and the vicinity thereof of an ink injection head.

FIG. 3 is a partial cross-sectional view of one nozzle 25 and the vicinity thereof of the ink injection head 15. As shown in FIG. 3, the ink injection head 15 includes a hollow case main body 21 provided with an opening 21*a*, and a vibration plate 22 attached to the case main body 21 so as to cover the opening 21*a*. The vibration plate 22 demarcates a portion of a pressure chamber 23. An area enclosed by the case main body 21 and the vibration plate 22 is the pressure chamber 23. The case main body 21 is preferably formed of a resin, for example. The vibration plate 22 may be any component elastically deformable to the inside and the outside of the pressure chamber 23. The "inside" and the "outside" of the pressure chamber 23 respectively refer to the top side and the bottom side in FIG. 3. The vibration plate 22 is typically a resin film.

A surface of the case main body 21 (left surface in FIG. 3) is provided with an ink inlet 24. The ink inlet 24 allows the ink to flow into the case main body 21. The ink inlet 24 merely needs to be in communication with the pressure chamber 23, and there is no limitation on the position of the ink inlet 24. The ink inlet 24 is in communication with the ink cartridge 11C. The ink is supplied to the pressure chamber 23 via the ink inlet 24, and the ink of a predetermined amount is temporarily stored in the pressure chamber 23. A bottom surface 21*b* of the case main body 21 is provided with the nozzle 25 injecting the ink. The nozzle 25 injects an ink drop toward the recording paper sheet 5. A liquid surface (free surface) inside the nozzle 25 forms a meniscus 25*a*.

The pressure chamber 23 has the Helmholtz characteristic vibration period Tc. The Helmholtz characteristic vibration period Tc is uniquely specified by the material, size, shape or location of each of components defining the pressure chamber 23, for example, the case main body 21 and the vibration plate 22, the opening area size of the nozzle 25, physical properties (e.g., viscosity) of the ink, and the like. The Helmholtz characteristic vibration period Tc is a vibration period characteristic to the ink injection head 15. The Helmholtz characteristic vibration period Tc preferably is, for example, a vibration period of several microseconds to several ten microseconds. After an ink drop is injected, the pressure chamber 23 has a residual vibration having such a vibration period.

A piezoelectric element 26 is in contact with a surface of the vibration plate 22 opposite to the pressure chamber 23. An end of the piezoelectric element 26 is secured to a secured member 29. The piezoelectric element 26 is a type of actuator. The piezoelectric element 26 is connected with the controller 18 via a flexible cable 27. The piezoelectric element 26 is supplied with a driving signal or the like via the flexible cable 27. In this preferred embodiment, the piezoelectric element 26 is a stack body including a piezoelectric material layer and a conductive layer stacked alternately. The piezoelectric element 26 is extended or contracted based on the driving signal supplied thereto by the controller 18 to act to elastically deform the vibration plate 22 to the inside or to the outside of the pressure chamber 23. In this example, the piezoelectric element 26 is a piezoelectric transducer (PZT) of a longitudinal vibration mode. The PZT of the longitudinal vibration mode is extendable in the stacking direction, and, for example, is contracted when being discharged and is extended when being charged. There is no specific limitation on the type of the piezoelectric element 26. The actuator is not limited to the piezoelectric element 26.

In the ink injection head 15 having the above-described structure, the piezoelectric element 26 is contracted by, for example, a decrease in the potential thereof from an intermediate potential. When this occurs, the vibration plate 22 follows this contraction to be elastically deformed to the outside of the pressure chamber 23 from an initial position, and thus the pressure chamber 23 is expanded. The expression that the "pressure chamber 23 is expanded" refers to that the capacity of the pressure chamber 23 is increased by the deformation of the vibration plate 22. Next, the potential of the piezoelectric element 26 is increased to extend the piezoelectric element 26 in the stacking direction. As a result, the vibration plate 22 is elastically deformed to the inside of the pressure chamber 23, and thus the pressure chamber 23 is contracted. The expression that the "pressure chamber 23 is contracted" refers to the capacity of the pressure chamber 23 being decreased by the deformation of the vibration plate 22. Such expansion/contraction of the pressure chamber 23 changes the pressure inside the pressure chamber 23. Such a change in the pressure inside the pressure chamber 23 pressurizes the ink in the pressure chamber 23, and the ink is injected from the nozzle 25 as an ink drop. Then, the potential of the piezoelectric element 26 is returned to the intermediate potential, so that the vibration plate 22 returns to the initial position and the pressure chamber 23 is expanded. At this point, the ink flows into the pressure chamber 23 via the ink inlet 24.

The controller 18 is connected with the carriage motor 8*a* of the carriage moving mechanism 8, the feed motor of the paper feeding mechanism, the liquid transmission pump 13, and the ink injection head 15. The controller 18 is configured or programmed to control operations of these components. The controller 18 is typically a computer. The controller 18 includes, for example, an interface (I/F) receiving printing data or the like from an external device such as a host computer or the like, a central processing unit (CPU) executing a command of a control program, a ROM storing the program to be executed by the CPU, a RAM usable as a working area in which the program is developed, and a storage device (storage medium) such as a memory or the like storing the above-described program and various other types of data.

Figure 4:
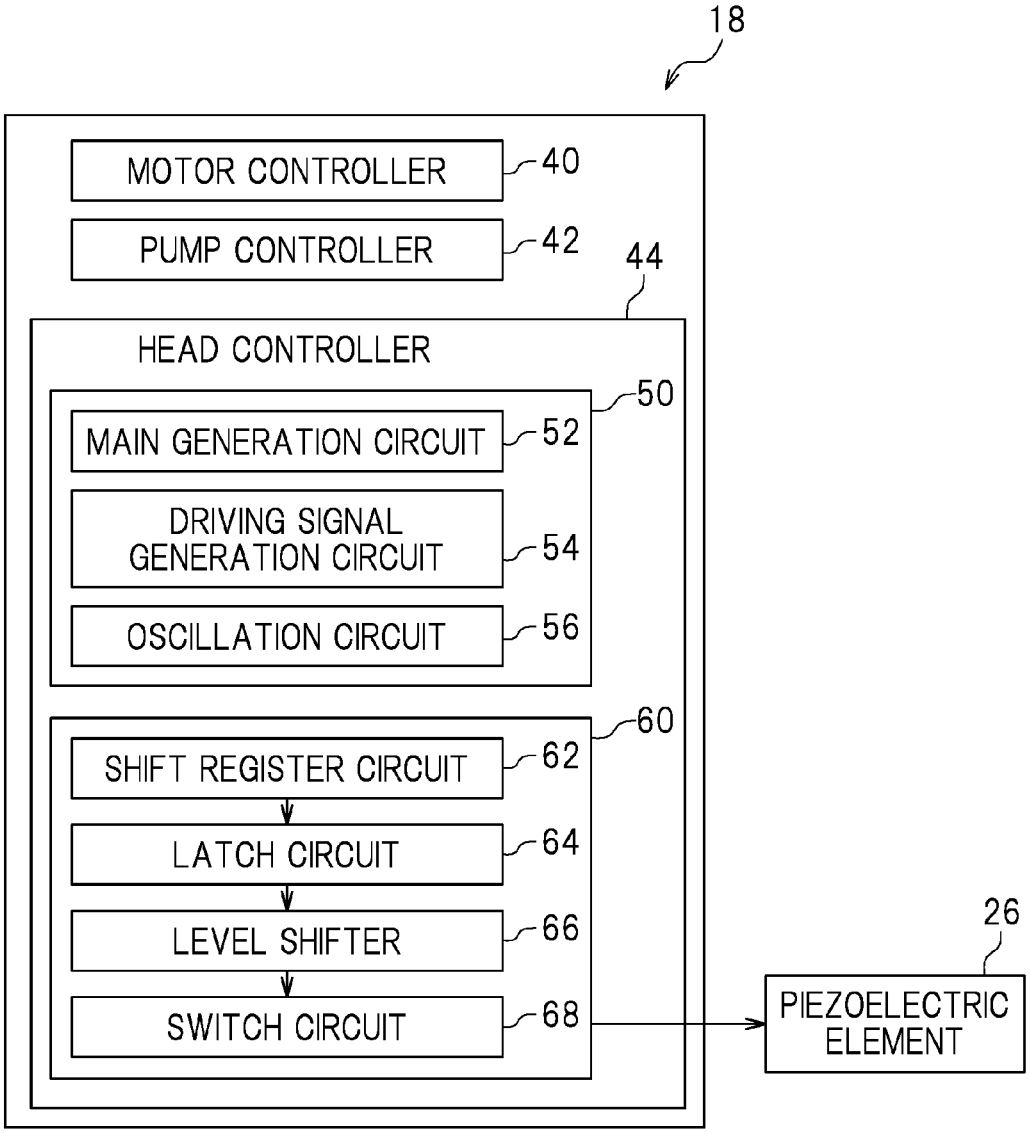
FIG. 4 is a block diagram showing a structure of a controller.

FIG. 4 is a block diagram showing a structure of the controller 18. The controller 18 includes a motor controller 40 controlling the carriage motor 8*a* of the carriage moving mechanism 8, the feed motor of the paper feeding mechanism and the like, a pump controller 42 controlling the liquid transmission pump 13 to be, for example, started or stopped, and a head controller 44 controlling, for example, supply of a driving signal to the piezoelectric element 26 of the ink injection head 15. The controllers 40, 42 and 44 operate in association with each other.

The head controller 44 includes a driving signal generator 50 and a driving signal supplier 60. The driving signal generator 50 generates gray scale data based on printing data. The driving signal supplier 60 selects one or at least two driving pulses from a plurality of driving pulses included in a common driving signal based on the gray scale data generated by the driving signal generator 50, and supplies the selected driving pulse (s) to the piezoelectric element 26. In this step, all the driving pulses or a portion of the driving pulses is selected, so that a dot having a size among various sizes, for example, a large dot, a medium dot or a small dot is printed.

The driving signal generator 50 includes a main generation circuit 52, a driving signal generation circuit 54, and an oscillation circuit 56. The oscillation circuit 56 generates a transfer clock signal CK. The driving signal generation circuit 54 generates a predetermined common driving signal COM including a plurality of driving pulses in one liquid drop injection period Pa. The common driving signal COM is pattern data of a driving waveform stored on the ROM. The driving pulses each have a pulse waveform to inject an ink drop having a predetermined amount of ink from the nozzle 25 of the ink injection head 15 or a pulse waveform for microscopically vibrating the meniscus 25*a* to such a degree as not to inject an ink drop from the nozzle 25. The common driving signal COM will be described below in detail. The driving signal generation circuit 54 generates the common driving signal COM in repetition, more specifically, in each one liquid drop injection period Pa.

The printing data is input to the main generation circuit 52 from an external device. The printing data is represented by, for example, a character code, a graphic function, image data or the like. The input printing data is developed into gray scale data corresponding to a dot pattern by the CPU. The developed gray scale data is temporarily stored on the RAM. When gray scale data SI of one row corresponding to one cycle of scanning is obtained, the gray scale data SI is output to the driving signal supplier 60 together with the clock signal CK.

The driving signal supplier 60 includes a shift register circuit 62, a latch circuit 64, a level shifter 66, and a switch circuit 68. To the shift register circuit 62, the gray scale data SI synchronized to the clock signal CK is input. To the latch circuit 64, a latch signal LAT, defining the timing ΔT at which one liquid drop injection period Pa starts, is input. When the latch signal LAT is input, the latch circuit 64 latches the gray scale data SI. The latched gray scale data SI is input to the level shifter 66 as, for example, two-bit gray scale data of "1" and "0". The level shifter 66 acts as a voltage amplifier. For example, when the gray scale data is "1", the level shifter 66 outputs an electric signal having a voltage increased to about several ten volts to the switch circuit 68. To the switch circuit 68, the common driving signal COM is input. When the switch circuit 68 is actuated, an arbitrary driving pulse is selected from the common driving signal COM, and is supplied to the piezoelectric element 26. The switch circuit 68 is coupled with the piezoelectric element 26. The piezoelectric element 26 is extended or contracted in accordance with the waveform of the above-selected driving pulse, and an ink drop is injected from the nozzle 25 based on the motion of the piezoelectric element 26. By contrast, when the gray scale data is "0", the electric signal actuating the switch circuit 68 is blocked against the level shifter 66. Therefore, the driving pulse is not supplied to the piezoelectric element 26. Alternatively, when the gray scale data is "0", a microscopically vibrating pulse to such a degree as not to inject an ink drop may be supplied.

Figure 5:
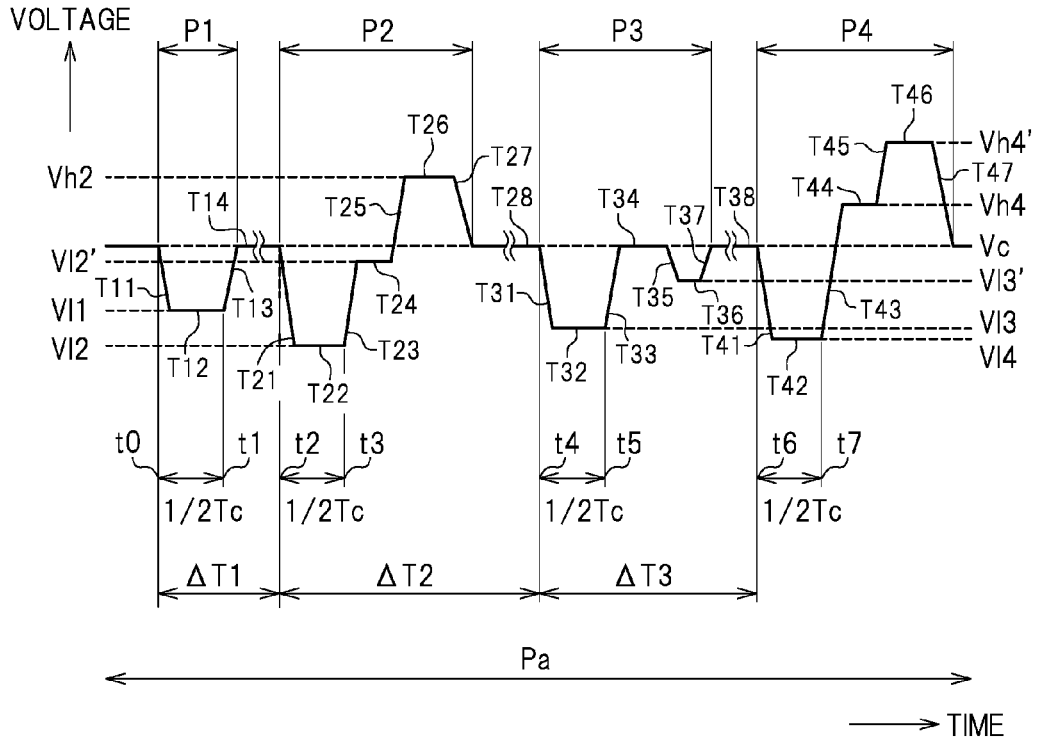
FIG. 5 shows a common driving signal according to a preferred embodiment of the present invention.

Now, the common driving signal COM will be described. FIG. 5 shows a common driving signal of a preferred embodiment of the present invention. In this preferred embodiment, four driving pulses, namely, a first driving pulse P1, a second driving pulse P2, a third driving pulse P3 and a fourth driving pulse P4, are generated in a time-series manner and four ink drops (a first ink drop, a second ink drop, a third ink drop and a fourth ink drop) are injected continuously in a unit period Pa (one liquid drop injection period) preset for forming one dot. The driving pulses P1, P2, P3 and P4 have trapezoidal waveforms respectively including discharge waveforms T11, T21, T31 and T41 by which the potential of the piezoelectric element 26 is decreased from the intermediate potential to expand the pressure chamber 23, discharge maintaining waveforms T12, T22, T32 and T42 by which the potential is maintained at the decreased level for a predetermined time period to keep the pressure chamber 23 in an expanded state, and charge waveforms T13, T23, T33 and T43 by which the potential of the piezoelectric element 26 is increased to contract the pressure chamber 23.

In this preferred embodiment, the discharge time period (the sum of the time period in which the piezoelectric element 26 is discharged and the time period in which the potential thereof is maintained at the discharge potential) of each of the first and second driving pulses P1 and P2 preferably is set to about ½ of the Helmholtz characteristic vibration period Tc of the ink injection head 15, for example. Timing ΔT1 at which the second driving pulse P2 starts preferably is set to about m×Tc (m≥1) after the start of the first driving pulse P1, for example. The speed at which the second ink drop is injected by the second driving pulse P2 preferably is set to be higher than, or equal to, a speed at which the first ink drop is injected by the first driving pulse P1. Timing ΔT2 at which the third driving pulse P3 starts is preferably set to about (n+(½))×Tc (n≥1) after the start of the second driving pulse P2, for example. Timing ΔT3 at which the fourth driving pulse P4 starts is preferably set to about p×Tc (p≥2) after the start of the third driving pulse P3, for example. The speed at which the fourth ink drop is injected by the fourth driving pulse P4 preferably is set to be higher than, or equal to, a speed at which the third ink drop is injected by the third driving pulse P3. The first through fourth ink drops form one large ink drop (one dot) on the recording paper sheet 5. This will be described in more detail. First, the second ink drop is merged with the first ink drop and lands on the recording paper sheet 5. Then, the fourth ink drop is merged with the third ink drop and lands on the recording paper sheet 5, at the same or substantially the same position as that of the first ink drop and the second ink drop already landed. As a result, one large ink drop is formed on the recording paper sheet 5. This will be described below in detail.

The first driving pulse P1 starts at the intermediate potential Vc, is decreased to a first minimum potential V11 at a constant gradient (see the discharge waveform T11), and then is maintained at the first minimum potential V11 for a predetermined time period (see the discharge maintaining waveform T12). Where the start time of the discharge waveform T11 is t0 and the finish time of the discharge maintaining waveform T12 is t1, t0 and t1 are preferably set to satisfy expression (1): t1−t0=(½)×Tc. Then, the potential of the first driving pulse P1 is increased to the intermediate potential Vc at a constant gradient (see the charge waveform T13). As a result, the first ink drop is injected from the nozzle 25 at a predetermined speed. After the first driving pulse P1, the intermediate potential Vc is maintained for a predetermined time period (see an intermediate potential maintaining waveform T14).

Figure 6A:
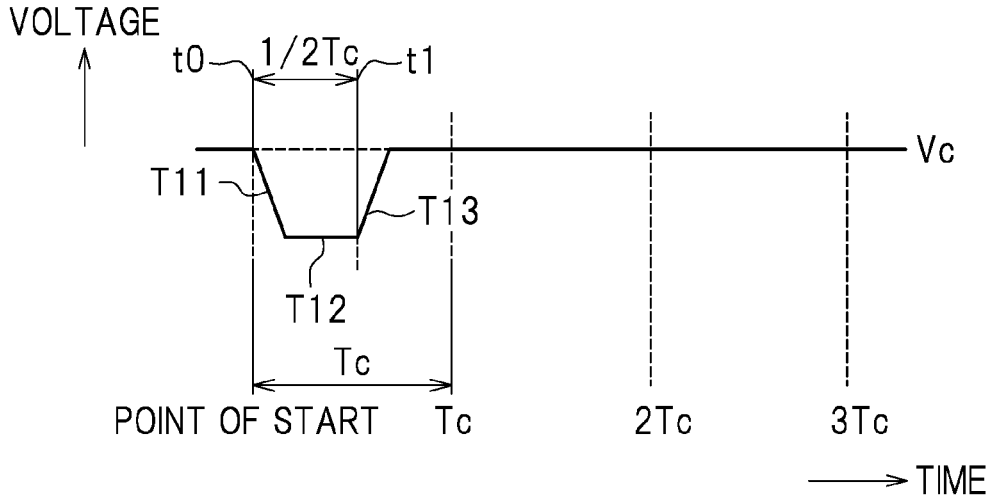
FIG. 6A shows a first driving pulse.
Figure 6B:
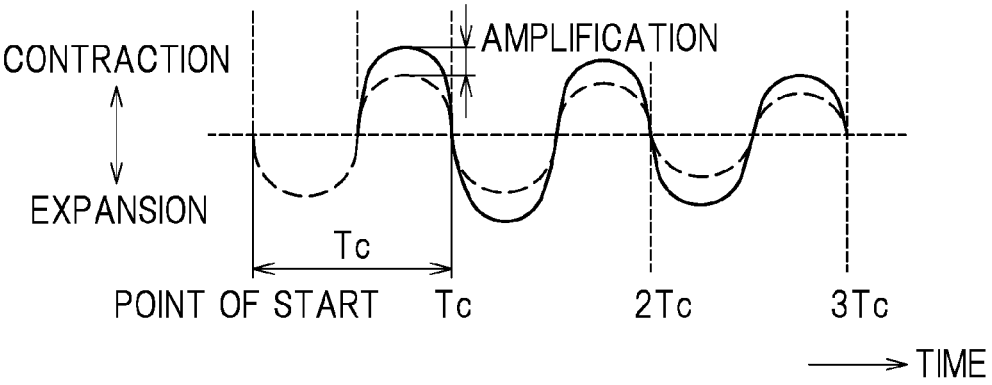
FIG. 6B shows a state of a pressure chamber in correspondence with the first driving pulse shown in FIG. 6A.

An effect provided by satisfying expression (1) will be described. FIG. 6A shows the first driving pulse P1. FIG. 6B shows a state of the pressure chamber 23 corresponding to the first driving pulse P1. The piezoelectric element 26 is contracted when the voltage value is decreased by the discharge, and is extended when the voltage value is increased by the charge. The pressure chamber 23 is expanded when the piezoelectric element 26 is contracted, and is contracted when the piezoelectric element 26 is extended. Therefore, in expression (1), t1−t0 represents the time period in which the pressure chamber 23 is maintained in the expanded state. The contraction of the piezoelectric element 26 causes, in the pressure chamber 23, a Helmholtz characteristic vibration of the characteristic vibration period Tc as represented by the dashed line in FIG. 6B. The piezoelectric element 26 is switched from the contracted state to the extended state at the timing satisfying the above expression (1), so that the amplitude of the Helmholtz characteristic vibration is increased as represented by the solid line in FIG. 6B. In this manner, the expansion/contraction of the pressure chamber 23 is synchronized to the Helmholtz characteristic vibration, so that the ink injection is stabilized and a relatively large ink drop is injected at a lower driving voltage. As a result, a large dot is formed on the recording paper sheet 5 with high precision.

The second driving pulse P2 starts at the timing ΔT1, which is m×Tc (m≥1) after the start of the first driving pulse P1. Thus, the second driving pulse P2 is synchronized to the Helmholtz characteristic vibration period Tc of the expansion and contraction vibration of the pressure chamber 23 excited by the first driving pulse P1, and the ink injection is stabilized. If the timing of start of the second driving pulse P2 is, for example, {m+(½)}×Tc, the pressure chamber 23 starts to expand at the timing when the pressure chamber 23 starts to contract at the Helmholtz characteristic vibration period Tc. In this case, the phase of a driving signal of the second driving pulse P2 does not match the phase of the Helmholtz characteristic vibration. When this occurs, for example, the meniscus 25*a* is destabilized. As a result, the second ink drop does not jump at a sufficiently high speed, or is not provided in a sufficient amount of liquid to forma liquid drop. This easily causes generation of mist. For avoiding this, the second driving pulse P2 starts at the timing when the pressure chamber 23 starts to expand at the Helmholtz characteristic vibration period Tc. This prevents the operation of canceling the vibration of the pressure chamber 23 expanding at the Helmholtz characteristic vibration period Tc. Thus, the injection stability is improved. As a result, a dot of a stable size is formed on the recording paper sheet 5 at a predetermined position.

In this specification, "m×Tc" encompasses a value exactly matching m×Tc theoretically and also a value with fluctuation or an error of Tc. For example, it is preferable that "m×Tc" is a theoretical value in the range of m×Tc−(⅙)×Tc to m×Tc+(⅙)×Tc.

For a large printer for industrial use as shown in, for example, FIG. 1, it is preferable that the value of m is as small as possible from the point of view of causing all the first through fourth ink drops to form one large ink drop on the recording paper sheet 5. In the case where the value of m is large, for example, in the case where m is 3 or greater, the first ink drop and the following ink drops (second ink drop, third ink drop, fourth ink drop) may possibly land at discrete positions from each other on the recording paper sheet 5, under a certain injection condition. In consideration of such a case, the value of m is preferably m≤2, for example, 1. According to the studies performed by the present inventors, in the case where m=1, a satellite drop moving slowly may be generated after the second ink drop. However, this satellite drop is absorbed into the fourth ink drop (described below), which is merged with the third ink drop and lands on the recording paper sheet 5. Therefore, decline of the printing quality caused by the generation of mist is suppressed or prevented.

The second driving pulse P2 starts at the intermediate potential Vc, is decreased to a second minimum potential V12 at a constant gradient (see the discharge waveform T21), and then is maintained at the second minimum potential V12 for a predetermined time period (see the discharge maintaining waveform T22). In this preferred embodiment, the potential V12 reached by the discharge waveform T21 by discharge preferably is set to be lower than, or equivalent to, the potential V11 reached by discharge by the discharge waveform T11 of the first driving pulse P1. In other words, the amount of potential change provided by the discharge waveform T21 of the second driving pulse P2 is preferably set to be larger than, or equal to, the amount of potential change provided by the discharge waveform T11 of the first driving pulse P1. The discharge time period of the discharge waveform T21 is preferably set to be equal to the discharge time period of the discharge waveform T11 of the first driving pulse P1. The discharge maintaining time period of the discharge maintaining waveform T22 is preferably set to be equal to the discharge maintaining time period of the discharge maintaining waveform T12 of the first driving pulse P1.

Where the start time of the discharge waveform T21 is t2 and the finish time of the discharge maintaining waveform T22 is t3, t2 and t3 are preferably set to satisfy expression (2): $t3-t2=(1/2)\times Tc$. An effect provided by such a setting is the same as the effect described above regarding expression (1). As a result, the second driving pulse P2 amplifies the expansion of the pressure chamber 23 more efficiently than the first driving pulse P1. After this, the potential of the second driving pulse P2 is increased to a potential V12' at a constant gradient (see the charge waveform T23). As a result, the second ink drop is injected from the nozzle 25 at a predetermined speed. The potential V12' is maintained for a predetermined time period (see a potential maintaining waveform T24).

The amount of potential change provided by the charge waveform T23 of the second driving pulse P2, namely, (V12'−V12), is preferably set to be larger than, or equal to, the amount of potential change provided by the charge waveform T13 of the first driving pulse P1, namely, (Vc−V11). With such a setting, the second ink drop is injected at a speed higher than, or equivalent to, the speed at which the first ink drop is injected. In this preferred embodiment, (V12'−V12) is preferably set to about (V12'−V12)=1.4 (Vc−V11), so that the second ink drop is injected at a speed about 1.1 times as high as the speed at which the first ink drop is injected, for example. This allows the first ink drop and the second ink drop to be merged together before landing on the recording paper sheet 5 (in other words, while jumping). Although there is no specific limitation on the value of (V12'−V12), it is preferable that (V12'−V12) is at most about three times as high as, for example, at most twice as high as, (Vc−V11), from the point of view of suppressing or preventing the vibration of the meniscus 25*a* small.

In this preferred embodiment, the potential of the second driving pulse P2 is further increased to a second maximum potential Vh2 at a constant gradient (see a charge waveform T25), is maintained at the second maximum potential Vh2 for a predetermined time period (see a charge maintaining waveform T26), and then is decreased to the intermediate potential Vc at a constant gradient (see a discharge waveform T27). The waveform defined by the waveforms T25 through T27 is of an opposite phase to that of the Helmholtz characteristic vibration. In other words, because of the trapezoidal waveform including the waveforms T25 through T27, an expansion and contraction vibration of an opposite phase to that of the expansion and contraction vibration generated by the first and second driving pulses P1 and P2 is applied to the pressure chamber 23. This allows the kinetic energy of the meniscus 25*a* to be decreased and thus the residual vibration after the second ink drop is injected is effectively attenuated. As a result, before the third driving pulse P3 is started, the pressure chamber 23 and the meniscus 25*a* are stabilized. This allows the ink drops to be injected with a more uniform size at a more uniform speed. Thus, higher quality printing (namely, printing with little dot variance) is realized. After the second driving pulse P2, the intermediate potential Vc is maintained for a predetermined time period (see an intermediate potential maintaining waveform T28).

The third driving pulse P3 starts at the timing ΔT2, which is about $(n+(1/2))\times Tc$ after the start of the second driving pulse P2 ($n\geq 1$), for example. This prevents the third ink drop from becoming too large. As a result, the ink is prevented from being attached to the opening or the vicinity thereof of the nozzle 25 due to the overflow of the meniscus 25*a*, and thus the meniscus 25*a* is stabilized. Therefore, the ink is prevented from being curved while jumping or from having any other inconvenience, and the injection stability and the precision in the landing position of the ink drop are improved.

Figure 7A:
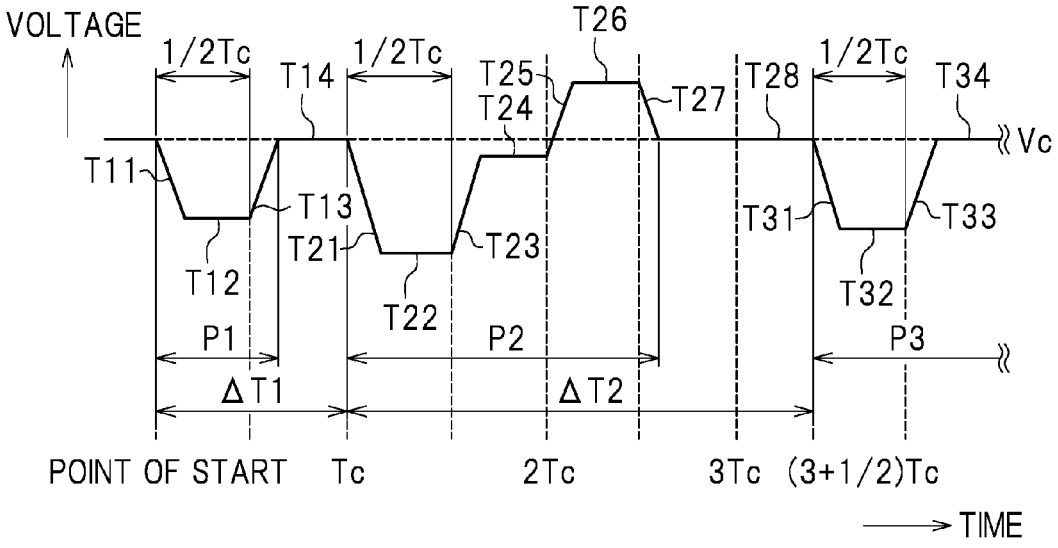
FIG. 7A shows first through third driving pulses according to a preferred embodiment of the present invention.
Figure 7B:
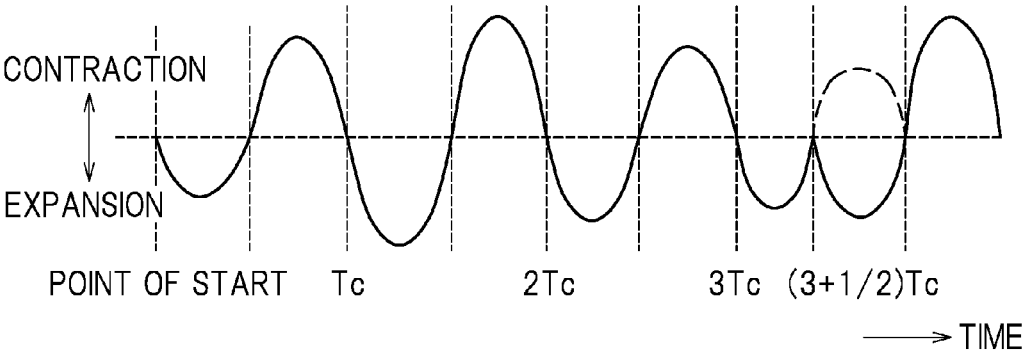
FIG. 7B shows a state of the pressure chamber in correspondence with the first through third driving pulses shown in FIG. 7A.

FIG. 7A and FIG. 7B respectively show the first through third driving pulses P1 through P3 according to a preferred embodiment of the present invention, and the state of the pressure chamber 3 in correspondence therewith. In this preferred embodiment, the timing ΔT1 at which the second driving pulse P2 starts is $1\times Tc$ (i.e., m=1) after the start of the first driving pulse P1, and the timing ΔT2 at which the third driving pulse P3 starts is $(2+(1/2))Tc$ (i.e., n=2) after the start of the second driving pulse P1.

As represented in FIG. 7B with the solid line, when the above-described first driving pulse P1 (trapezoidal waveform including the waveforms T11 through T13) is supplied, the expansion and contraction vibration of the pressure chamber 23 at the Helmholtz characteristic vibration period Tc is amplified. Next, when the above-described second driving pulse P2 (trapezoidal waveform including the waveforms T21 through T23) is supplied, the expansion and contraction vibration of the pressure chamber 23 amplified by the first driving pulse P1 is further amplified. Next, the trapezoidal waveform including the waveforms T25 through T27 attenuates (damps) the expansion and contraction vibration of the pressure chamber 23. Then, in this preferred embodiment, the third driving pulse P3 starts at the timing ΔT2, which is $(2+(1/2))Tc$ (i.e., n=2) after the start of the second driving pulse P2. Namely, the third driving pulse P3 starts at the timing when the pressure chamber 23 starts contracting. As a result, the contraction vibration as represented by the dashed line in FIG. 7B is cancelled, and thus the expansion and contraction vibration of the pressure chamber 23 is damped. As a result, the speed at which the third ink drop is injected is decreased, and thus the third ink drop jumps as being separated from the first and second ink drops injected prior to the third ink drop and jumping in the air. As a result, the third ink drop is prevented from becoming too large, and is prevented from being attached to the opening or the vicinity thereof of the nozzle 25. Therefore, the injection stability is maintained high for a long time period.

In this specification, "n×Tc" encompasses a value exactly matching n×Tc theoretically and also a value with fluctuation or an error of Tc. For example, "n×Tc" may be a theoretical value in the range of $n\times Tc-(1/6)\times Tc$ to $n\times Tc+(1/6)\times Tc$.

There is no upper limit of the value of "n" in the above expression because the value depends on, for example, the printing speed or the like. The value of n may be, for example, equal to, or different from, the value of m mentioned above. Like the value of m, it is preferable that the value of n is as small as possible. The value of n is preferably 5 or less, more preferably 3 or less, for example, n=2. With such a value of n, the third ink drop injected by the third driving pulse P3 may stably land on the recording paper sheet 5, at the same or substantially the same position as that of the first ink drop and the second ink drop.

The third driving pulse P3 starts at the intermediate potential Vc, is decreased to a third minimum potential V13 at a constant gradient (see the discharge waveform T31), and then is maintained at the third minimum potential V13 for a predetermined time period (see the discharge maintaining waveform T32). In this preferred embodiment, the potential V13 reached by the discharge waveform T31 by discharge is preferably set to be lower than the potential V11 reached by the discharge waveform T11 of the first driving pulse P1, and to be higher than, or equivalent to, the potential V12 reached by the discharge waveform T21 of the second driving pulse P2. In other words, the amount of potential change provided by the discharge waveform T31 of the third driving pulse P3 is preferably set to be larger than the amount of potential change provided by the discharge waveform T11 of the first driving pulse P1 and to be smaller than, or equivalent to, the amount of potential change provided by the discharge waveform T21 of the second driving pulse P2.

The third driving pulse P3 starts at the timing ΔT2, which is (n+(½))×Tc (n≥1) after the start of the second driving pulse P2. Thus, the third ink drop is effectively merged with the fourth ink drop described below and lands at a position close to that of the first ink drop and the second ink drop already landed on the recording paper sheet 5, and forms one ink drop together with the first ink drop and the second ink drop on the recording paper sheet 5. In one example, the amount of potential change provided by the discharge waveform T31 of the third driving pulse P3 is preferably set to be, for example, smaller than, or equivalent to, about 1.3 times the amount of potential change provided by the discharge waveform T11 of the first driving pulse P1. In this case, the third ink drop lands on the recording paper sheet 5 as being separate from the merged drop of the first ink drop and the second ink drop already landed.

The discharge time period of the discharge waveform T31 is preferably set to be equal or substantially equal to the discharge time period of each of the discharge waveform T11 of the first driving pulse P1 and the discharge waveform T21 of the second driving pulse P2. The discharge maintaining time period of the discharge maintaining waveform T32 is preferably set to be equal or substantially equal to the discharge maintaining time period of each of the discharge maintaining waveform T12 of the first driving pulse P1 and the discharge maintaining waveform T22 of the second driving pulse P2.

Where the start time of the discharge waveform T31 is t4 and the finish time of the discharge maintaining waveform T32 is t5, it is preferable that t4 and t5 satisfy expression (3): t5−t4=(½)×Tc. In this case, the effect of damping the above-described expansion and contraction vibration of the pressure chamber 23 is better exhibited. Then, the potential of the third driving pulse P3 is increased to the intermediate potential Vc at a constant gradient (see the charge waveform T33). As a result, the third ink drop is injected from the nozzle 25 at a predetermined speed. The intermediate potential Vc is maintained for a predetermined time period (see an intermediate potential maintaining waveform T34).

In this preferred embodiment, the amount of potential change provided by the charge waveform T33 of the third driving pulse P3, namely, (Vc−V13), is preferably set to be larger than the amount of potential change provided by the charge waveform T13 of the first driving pulse P1, namely, (Vc−V11) and to be smaller than the amount of potential change provided by the charge waveform T23 of the first driving pulse P2, namely, (V12'−V12). Thus, the third ink drop is effectively merged with the fourth ink drop described below and lands at a position close to that of the first ink drop and the second ink drop already landed on the recording paper sheet 5, and forms one ink drop together with the first ink drop and the second ink drop on the recording paper sheet 5.

The amount of potential change provided by the charge waveform T33 of the third driving pulse P3, namely, (Vc−V13), is preferably set to be smaller than, or equivalent to, about 1.3 times the amount of potential change provided by the charge waveform T13 of the first driving pulse P1, namely, (Vc−V11). In addition, the third driving pulse P3 starts at the timing ΔT2, which is (n+(½))×Tc after the start of the second driving pulse P2 (n≥1). As a result, the speed at which the third ink drop is injected is, for example, about 60% to about 80% of the speed at which the speed of the merged drop of the first ink drop and the second ink drop, and the third ink drop is separate from the merged drop. Typically, the speed of the third ink drop is slowest among the speeds of the merged drop of the first ink drop and the second ink drop, the third ink drop and the fourth ink drop.

In this preferred embodiment, the third driving pulse P3 has a pulse waveform for microscopically vibrating the meniscus 25*a* to such a degree as not to inject an ink drop. Specifically, after the waveforms T31 through T33 described above, the potential of the third driving pulse P3 is decreased to a potential V13' at a constant gradient (see a discharge waveform T35), is maintained at the potential V13' for a predetermined time period (see a discharge maintaining waveform T36), and is increased to the intermediate potential Vc at a constant gradient (see a charge waveform T37). As a result, the ink in the pressure chamber 23 is stirred to be made uniform, and thus the inconvenience such as clogging of the nozzle 25 is suppressed or prevented, and higher quality printing is realized. After the third driving pulse P3, the intermediate potential Vc is maintained for a predetermined time period (see an intermediate potential maintaining waveform T38).

The fourth driving pulse P4 starts at the timing ΔT3, which is p×Tc (p≥2) after the start of the third driving pulse P3. The timing of start of the fourth driving pulse P4 is synchronized to the Helmholtz characteristic vibration period Tc, so that the ink injection is stabilized.

In this specification, "p×Tc" encompasses a value exactly matching p×Tc theoretically and also a value with fluctuation or an error of Tc. For example, "p×Tc" may be a theoretical value in the range of p×Tc−(⅛)×Tc to p×Tc+(⅛)×Tc. More preferably, "p×Tc" is a theoretical value in the range of p×Tc−(1/10)×Tc to p×Tc+(1/10)×Tc.

Figure 8:
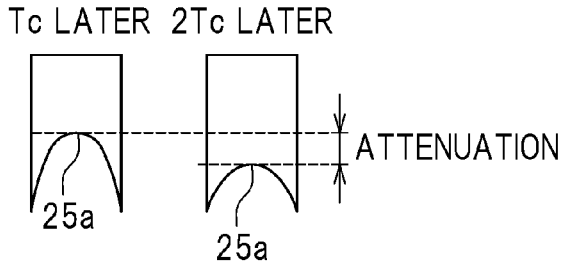
FIG. 8 shows states of a meniscus in the vicinity of the nozzle.

An effect provided by setting the timing when the fourth driving pulse P4 starts to 2Tc after the start of the third driving pulse P3, namely, setting the value of p to p≥2 will be described. In the pressure chamber 23 after the third ink drop is injected, there is a residual pressure fluctuation of the piezoelectric element 26. Therefore, the meniscus 25*a* of the nozzle 25 is in a state of significantly pulled into the pressure chamber 23. The meniscus 25*a* is continuously recovered toward the opening of the nozzle 25 along time, and the amount by which the meniscus 25*a* is pulled is gradually decreased. FIG. 8 shows a state of the meniscus 25*a* when the period Tc lapses after the start of the third driving pulse P3 and a state of the meniscus 25*a* when the period 2Tc lapses after the start of the third driving pulse P3. If the fourth pulse P4 starts in the state of the meniscus 25*a* when the period Tc lapses, namely, in the state where the meniscus 25*a* is significantly pulled into the pressure chamber 23, the time period after the injection of the third ink drop until the start of the injection of the fourth ink drop is short. Therefore, a so-called pulling ejection is generated, and the liquid amount of the fourth ink drop is small. In addition, the resistance of the flow path in the vicinity of the nozzle 25 is increased, and thus the speed of the satellite is easily decreased after the fourth ink drop is injected. As a result, mist is easily generated.

In the case where the fourth driving pulse P4 is started when the period 2Tc lapses after the start of the third driving pulse P3 (i.e., p≥2), the fourth ink drop is injected in a state where the meniscus 25*a* is recovered toward the opening of the nozzle 25 to a predetermined degree. Therefore, as compared with the case where the fourth driving pulse P4 starts when the period Tc lapses after the start of the third driving pulse P3, the liquid amount of the fourth ink drop is increased. The interval between the third driving pulse P3 and the fourth driving pulse P4 is extended. Therefore, the degree of contraction of the pressure chamber 23 is decreased, and the amount of ink passing the nozzle 25 per unit time is decreased. As a result, the resistance of the flow path in the vicinity of the nozzle 25 is decreased, and thus the speed of the fourth ink drop and the speed of the satellite generated by the fourth ink drop are increased. This allows the fourth ink drop to be stably injected with an ink amount larger than, or equivalent to, that of the third ink drop. Thus, the fourth ink drop is merged with the third ink drop properly. The generation of the satellite drop or the mist is suppressed or prevented. Therefore, a dot of a stable size is formed on the recording paper sheet 5 at a predetermined position.

As described above, the third ink drop is effectively merged with the fourth ink drop and lands at a position close to the first ink drop and the second ink drop already landed on the recording paper sheet 5, and forms one large ink drop on the recording paper sheet 5 together with the first ink drop and the second ink drop. The landing positions of the first through fourth ink drops on the recording paper sheet 5 are mainly determined based on the moving speed of the carriage 1, the injection speed of the ink drops, the injection timings of the ink drops, the ink amounts of the ink drops, the distance between the ink nozzle 25 and the recording paper sheet 5, and the like.

For a large printer for industrial use as shown in, for example, FIG. 1, it is preferable that the value of p is as small as possible from the point of view of causing all the first through fourth ink drops to form one large ink drop on the recording paper sheet 5. In the case where the value of p is large, for example, in the case where p is 4 or greater, the ink drops injected earlier (first ink drop, second ink drop) and the ink drops injected later (third ink drop, fourth ink drop) may possibly land at discrete positions from each other on the recording paper sheet 5, under a certain injection condition. In the meantime, in order to inject the fourth ink drop at a sufficiently high speed to stabilize the ink injection, it is preferable that the fourth ink drop is injected in a state where the meniscus 25*a* is not significantly pulled into the pressure chamber 23. In consideration of these, the value of p is preferably p 3, especially preferably p=2.

The fourth driving pulse P4 starts at the intermediate potential Vc, is decreased to a fourth minimum potential V14 at a constant gradient (see the discharge waveform T41), and then is maintained at the fourth minimum potential V14 for a predetermined time period (see the discharge maintaining waveform T42). In this preferred embodiment, the potential V14 reached by the discharge waveform T41 by discharge is preferably set to be lower than, or equivalent to, the potential V13 reached by discharge by the discharge waveform T31 of the third driving pulse P3. In one example, among the potentials V11, V12, V13 and V14 reached by discharge by the first through fourth driving pulses P1 through P4, the potential V14 is preferably set to be lowest. With such a setting, all the four ink drops (first through fourth ink drops) are effectively merged on the recording paper sheet 5.

The discharge time period of the discharge waveform T41 is preferably set to be equal or substantially equal to that of each of the discharge waveforms T11, T21 and T31 of the first through third driving pulses P1 through P3. The discharge maintaining time period of the discharge maintaining waveform T42 is preferably set to be equal or substantially equal to that of each of the discharge maintaining waveforms T12, T22 and T32 of the first through third driving pulses P1 through P3.

Where the start time of the discharge waveform T41 is t6 and the finish time of the discharge maintaining waveform T42 is t7, it is preferable that t6 and t7 satisfy expression (4): $t7-t6=(1/2)\times Tc$. In this case, the expansion and contraction vibration of the pressure chamber 23 is further stabilized. Then, the potential of the fourth driving pulse P4 is increased via the intermediate potential Vc to a fourth maximum potential Vh4 at a constant gradient (see the charge waveform T43). As a result, the fourth ink drop is injected from the nozzle 25 at a predetermined speed. The fourth maximum potential Vh4 is maintained for a predetermined time period (see an intermediate potential maintaining waveform T44).

The amount of potential change provided by the charge waveform T43 of the fourth driving pulse P4, namely, (Vh4−V14), is preferably set to be larger than, or equal to, the amount of potential change provided by the charge waveform T33 of the third driving pulse P3, namely, (Vc−V13). With such a setting, the fourth ink drop is injected at a speed higher than, or equivalent to, the speed at which the third ink drop is injected. In this preferred embodiment, (Vh4−V14) preferably is approximately set to (V4*h*−V14) =1.6 (Vc−V13), so that the fourth ink drop is injected at a speed about 1.2 times as high as the speed at which the third ink drop is injected. This allows the third ink drop and the fourth ink drop to be merged together properly before landing on the recording paper sheet 5 (in other words, while jumping). Although there is no specific limitation on the value of (Vh4−V14), it is preferable that (Vh4−V14) is at most about three times as high as, for example, at most twice as high as, (Vc−V13), from the point of view of suppressing the vibration of the meniscus 25*a* small.

The merged drop of the first ink drop and the second ink drop, and the merged drop of the third ink drop and the fourth ink drop, need to land at the same or substantially the same position with high precision so as form one ink drop on the recording paper sheet 5. A satellite drop which may be generated after each of the ink drops needs to land at the same position as the position of the above-mentioned two merged drops. Therefore, it is preferable that the speed of the fourth ink drop is higher than the speed of each of the first ink drop and the second ink drop, although this may vary in accordance with, for example, the distance between the ink injection head 15 and the recording paper sheet 5, the scanning speed of the carriage 1, and the like. In one example, it is preferable that the amount of potential change provided by the charge waveform T43 of the fourth driving pulse P4, namely, (Vh4–V14), is larger than, or equivalent to, the amount of potential change provided by the charge waveform T13 of the first driving pulse P1, namely, (Vc–V11), and the amount of potential change provided by the charge waveform T23 of the second driving pulse P2, namely, (V12'–V12). It is preferable that the speed of the fourth ink drop is, for example, at most about 1.5 times as high as, for example, at most about 1.2 times as high as, the speed of the first ink drop. With such a setting, the above-mentioned two merged drops stably land on the recording paper sheet 5 while being kept merged.

In this preferred embodiment, the potential of the fourth driving pulse P4 is further increased to a fifth maximum potential Vh4' at a constant gradient (see a charge waveform T45), is maintained at the fifth maximum potential Vh4' for a predetermined time period (see a charge maintaining waveform T46), and is decreased to the intermediate potential Vc at a constant gradient (see a discharge waveform T47). The trapezoidal waveform including the waveforms T45 through T47 are of an opposite phase to that of the Helmholtz characteristic vibration, like the waveform including the waveforms T25 through T27 included in the second driving pulse P2.

Figure 9:
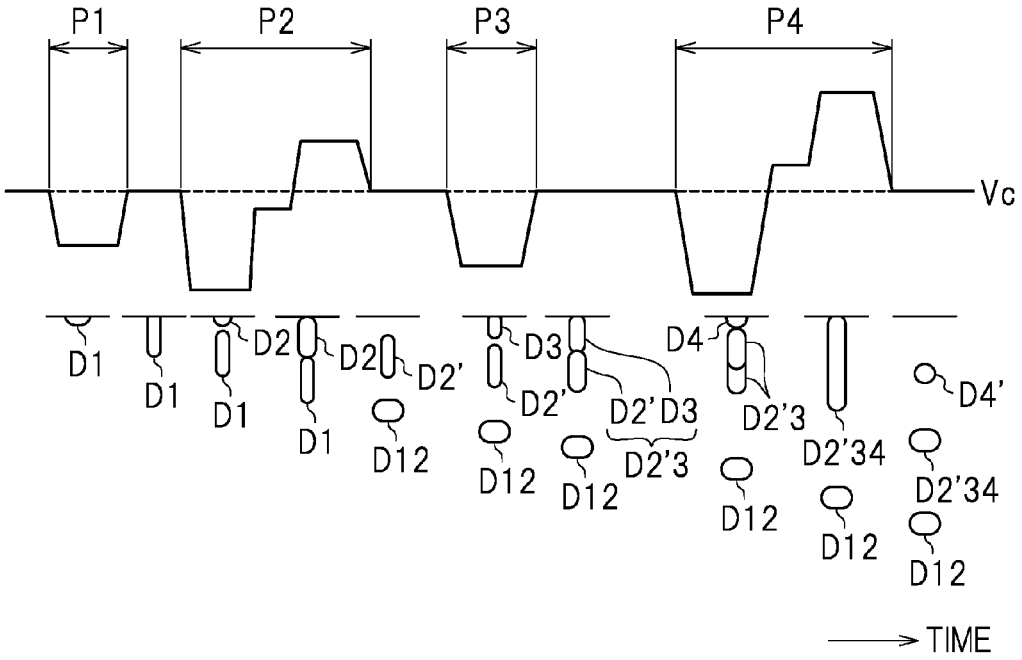
FIG. 9 shows how ink drops are merged to form one large dot.

FIG. 9 shows how the ink drops are merged while jumping to form one large dot. In this preferred embodiment, the first through fourth ink drops are caused to land at the same or substantially the same position on the recording paper sheet 5 to form one large dot on the recording paper sheet 5. In brief, the first ink drop (represented by "D1") and the second ink drop (represented by "D2") are merged together in the air to form one merged drop D12. The third ink drop (represented by "D3") and the fourth ink drop (represented by "D4") are merged together in the air and absorb a satellite D2' that is formed of the second ink drop D2 and is generated after the second ink drop D2 is injected, to form another merged drop D2'34. These two merged drops are caused to land at the same or substantially the same position on the recording paper sheet 5 to form one large dot.

This will be described in more detail. First, the first driving pulse P1 is provided to inject the first ink D1 from the nozzle 25. Next, the second driving pulse P2 is provided at a predetermined timing to inject the second ink drop D2 from the nozzle 25. The second ink drop D2 is injected at a speed higher than, or equal to, the speed at which the first ink drop D1 is injected. As a result, the first ink drop D1 and the second ink drop D2 are merged together in the air for form the merged drop D12. At this point, a part of the second ink drop D2 is separated from the merged drop D12 to become a satellite drop D2'. The satellite drop D2' jumps more slowly than the merged drop D12.

Next, the third driving pulse P3 is provided at a predetermined timing to inject the third ink drop D3 from the nozzle 25. The third ink drop D3 is injected at such a timing as to cancel the Helmholtz characteristic vibration, and thus jumps more slowly than the merged drop D12. Therefore, the third ink drop D3 is not merged with the merged drop D12 in the air. However, the third ink drop D3 is merged with the satellite drop D2', which jumps more slowly than the merged drop D12, to form a merged drop D2'3. Next, the fourth driving pulse P4 is provided at a predetermined timing to inject the fourth ink drop D4 from the nozzle. The fourth ink drop D4 is injected at a speed higher than, or equal to, the speed at which the third ink drop D3 is injected. The merged drop D2'3 and the fourth ink drop D4 are merged together in the air to form the merged drop D2'34. At this point, a portion of the fourth ink drop D4 is separated from the merged drop D2'34 to become a satellite drop D4'. The merged drop D12, the merged drop D2'34, and the satellite drop D4' land at the same or substantially the same position on the recording paper sheet 5 as overlapping each other. In this manner, one dot is formed.

Now, an operation of the printer 10 will be described. When the printer 10 is started by a user, the controller 18 performs a preparation to start printing. Specifically, various types of data representing the characteristics of the ink injection head 15 (e.g., the Helmholtz characteristic vibration period Tc) are read from the ROM of the controller 18. The controller 18 also decreases the potential of the piezoelectric element 26 to the intermediate potential to expand the pressure chamber 23 microscopically. The ink injection head 15 waits in this state until a driving signal is transmitted thereto from the controller 18.

When the user instructs the printer 10 to perform a printing operation, the motor controller 40 of the controller 18 drives the feed motor of the paper feeding mechanism. As a result, the recording paper sheet 5 is transported to be located at a predetermined printing position. The motor controller 40 of the controller 18 drives the carriage motor 8*a* of the carriage moving mechanism 8. The controller 18 drives the ink injection head 15 while moving the carriage 1 in the scanning direction (left-right direction in FIG. 1). In more detail, the controller 18 inputs a driving pulse to the piezoelectric element 26 of the ink injection head 15. This causes the piezoelectric element 26 to be extended or contracted in accordance with the driving pulse, which changes the pressure in the pressure chamber 23. As a result, an ink drop having a predetermined mass is injected from the nozzle 25 at a predetermined speed. The injected ink drop lands on the recording paper sheet 5 to form one dot.

When one row of printing is performed, the feed motor of the paper feeding mechanism is driven and the recording paper sheet 5 is located at the next printing position. Such an operation is repeated, and the printer 10 finishes predetermined printing. When there is no input of a driving pulse to the piezoelectric element 26 anymore, the controller 18 sets the potential of the piezoelectric element 26 to zero.

Hereinafter, with reference to FIG. 10, an example of a preferred embodiment of the present invention will be described. It is not intended to limit the present invention to the following specific example.

Figure 10:
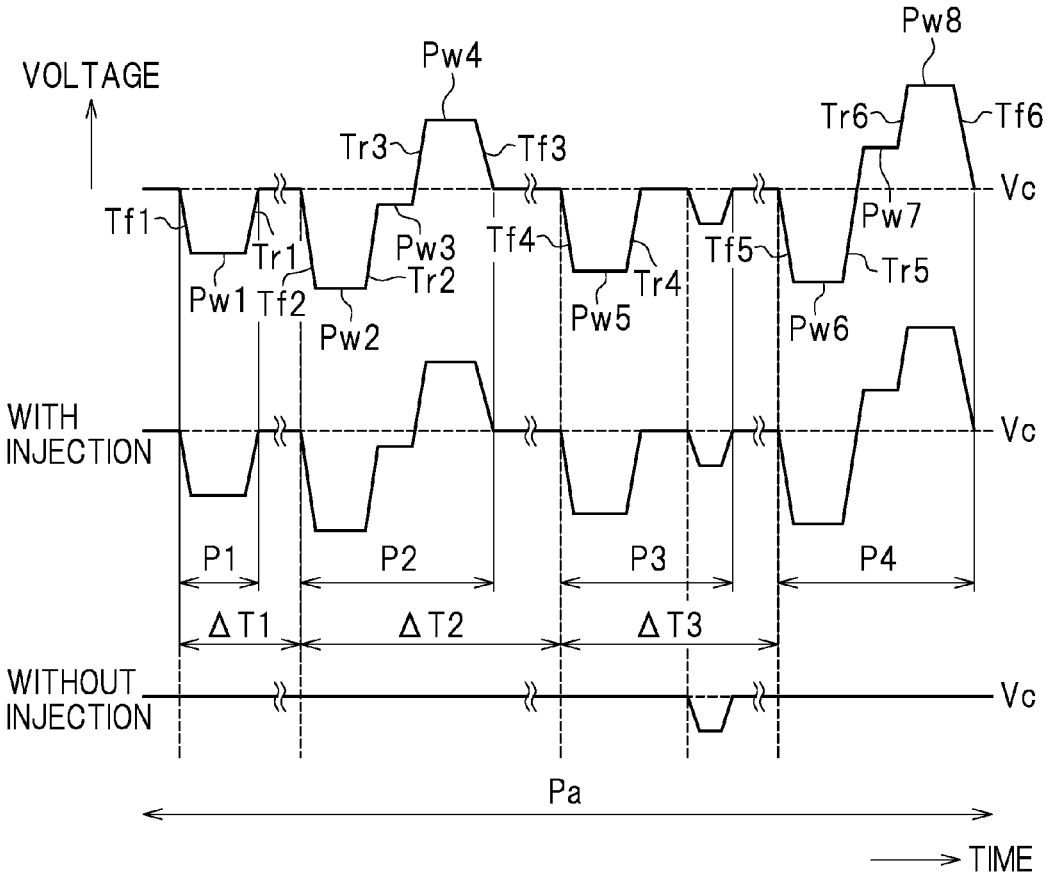
FIG. 10 shows a common driving signal in an example.

FIG. 10 shows a driving signal having a driving waveform including first through fourth driving pulses P1, P2, P3 and P4 to inject a liquid drop that are generated in a time-series manner in one liquid drop injection period Pa. With such a driving waveform, the ink drops are separated at a border between the first driving pulse P2 and the third driving pulse P3, and the ink drops are caused to land at approximately the same position on the recording paper sheet 5 to form one dot. The third driving pulse P3 includes a microscopic vibration pulse. In this preferred embodiment, the parameters as preferably set as follows.

Helmholtz characteristic vibration period Tc of the ink injection head: 6 μs

First driving pulse P1: Tf1=Tr1=1 μs; Pw1=2.25 μs; Tf1+Pw1=3.25 μs (=0.54 Tc)

Second driving pulse P2: Tf2=Tr2=Tf3=Tr3=1 μs; Pw2=Pw3=Pw4=2.25 μs; Tf2+Pw2=3.25 μs (=0.54 Tc)

Third driving pulse P3: Tf4=Tr4=1 μs; Pw5=2.25 μs; Tf4+Pw5=3.25 μs (=0.54 Tc)

Fourth driving pulse P4: Tf5=Tr5=Tf6=Tr6=1 μs; Pw6=2.25 μs; Pw7=Pw8=3 μs; Tf5+Pw6=3.25 μs (=0.54 Tc)

ΔT1: 1Tc (=1×6=6 μs) after the start of the first driving pulse P1

ΔT2: (2+(½))Tc (=2.5×6=1.5 μs) after the start of the second driving pulse P2

ΔT3: 2Tc (=2×6=12 μs) after the start of the third driving pulse P3

Where the driving frequency is about 21.0 kHz and the scanning speed of the carriage 1 is about 1185 mm/s, when the ink is injected, the merged drop of the first ink drop and the second ink drop jumps at a speed of about 6 m/s, and the merged drop of the third ink drop and the fourth ink drop jumps at a speed of about 6 m/s to about 7.2 m/s, for example. These merged drops land at the same position on the recording paper sheet 5. As a result, a dot of about 17 ng is formed per pixel, for example. By contrast, when the ink is not injected, the meniscus 25*a* is vibrated by a microscopic vibration pulse included in the third driving pulse P3 to such a degree as not to inject the ink drop. Thus, the ink in the pressure chamber 23 is stirred.

As described above, in the printer 10 in this preferred embodiment, the discharge time period (time period in which the pressure chamber 23 is in an expanded state) of each of the driving pulses P1 and P2 included in one liquid drop injection period Pa is preferably set to about ½ of the Helmholtz characteristic vibration period Tc, for example. With such a setting, each of the driving pulses P1 and P2 amplifies the expansion and contraction vibration of the pressure chamber 23. As a result, the injection of the ink drop is stabilized, and a large ink drop is injected. In the printer 10, the timing ΔT1 at which the second driving pulse P2 starts is preferably set to about m×Tc (m≥1) after the start of the first driving pulse P1. This amplifies the residual vibration of the pressure chamber 23 after the first ink drop is injected while allowing the second ink drop to be injected. In the printer 10, the second ink drop is injected at a speed higher than, or equal to, the speed at which the first ink drop is injected. As a result, the second ink drop and the first ink drop are merged together properly, and generation of mist is suppressed or prevented. Thus, the printer 10 improves the ink injection stability and the printing quality.

In the printer 10, the timing ΔT2 at which the third driving pulse P3 starts is preferably set to about (n+(½))×Tc (n≥1) after the start of the second driving pulse P2, for example. With such a setting, the third ink drop is injected as being separated from the first ink drop and the second ink drop already injected. This suppresses or prevents the third ink drop from becoming too large, and the injection stability and the precision of the landing position are improved without allowing the ink to be attached to the opening of the nozzle. The timing ΔT3 at which the fourth driving pulse P4 starts preferably is set to about p×Tc (p≥2) after the start of the third driving pulse P3, for example. With such a setting, the fourth ink drop is stably injected as a large ink drop to improve the injection stability. Since the fourth ink drop is injected at a speed higher than, or equal to, the speed at which the third ink drop is injected, the third ink drop and the fourth ink drop are merged together properly. The merged drop of the third ink drop and the fourth ink drop lands at the same or substantially the same position as that of the merged drop of the first ink drop and the second ink drop already landed, and thus one large dot is formed on the recording paper sheet 5. In addition, the jumping speed of the satellite generated after the fourth ink drop is injected is increased, and the satellite drop stably lands on the position of the dot formed above.

In this preferred embodiment, the first driving pulse P1 includes the first potential decreasing waveform T11 decreased from the intermediate potential Vc to the predetermined first minimum potential V11 and the first minimum potential maintaining waveform T12 maintained at the first minimum potential V11 for a predetermined time period. A total time period of the first potential decreasing waveform T11 and the first minimum potential maintaining waveform T12, namely, (t1−t0), is equal to (½)×Tc. The second driving pulse P2 includes the second potential decreasing waveform T21 decreased from the intermediate potential Vc to the predetermined second minimum potential V12 and the second minimum potential maintaining waveform T22 maintained at the second minimum potential V12 for a predetermined time period. A total time period of the second potential decreasing waveform T21 and the second minimum potential maintaining waveform T22, namely, (t3−t2), is equal to (½)×Tc. In this manner, the first driving pulse P1 and the second driving pulse P2 are synchronized to the Helmholtz characteristic vibration period to amplify the expansion and contraction vibration of the pressure chamber 23. Thus, the pressure chamber 23 is stably expanded.

In this preferred embodiment, where the amount of potential change of the first driving pulse P1 from the intermediate potential Vc to the first minimum potential V11 is ΔV1 and the amount of potential change of the second driving pulse P2 from the intermediate potential Vc to the second minimum potential V12 is ΔV2, ΔV1 and ΔV2 satisfy ΔV1≤ΔV2. Thus, the second ink drop is injected at a speed higher than, or equal to, the speed at which the first ink drop is injected, so that the first ink drop and the second ink drop are merged together before landing on the recording paper sheet 5.

In this preferred embodiment, the third driving pulse P3 includes the third potential decreasing waveform T31 decreased from the intermediate potential Vc to the third minimum potential V13 during a predetermined time period, and the fourth driving pulse P4 includes the fourth potential decreasing waveform T41 decreased from the intermediate potential Vc to the fourth minimum potential V14 during a predetermined time period. Where the amount of potential change of the third driving pulse P3 from the intermediate potential Vc to the third minimum potential V13 is ΔV3 and the amount of potential change of the fourth driving pulse P4 from the intermediate potential Vc to the fourth minimum potential V14 is ΔV4, ΔV3 and ΔV4 satisfy ΔV3≤ΔV4. Thus, the fourth ink drop is injected at a speed higher than, or equal to, the speed at which the third ink drop is injected, so that the third ink drop and the fourth ink drop are merged together before landing on the recording paper sheet 5.

In this preferred embodiment, ΔV1 and ΔV3 satisfy ΔV1<ΔV3≤1.3×ΔV1. Thus, the third ink drop lands on the recording paper sheer 5 as being separated from the merged drop of the first ink drop and the second ink drop. In other words, the merged drop is prevented from becoming too large when leaving the opening of the nozzle or while jumping in the air.

In this preferred embodiment, the fourth ink drop is injected at a speed higher than, or equal to, and at most about 1.2 times as high as, the speed at which the first ink drop is injected, for example. Thus, the ink drops land at the same or substantially the same position on the recording paper sheet 5 properly.

In this preferred embodiment, the third driving pulse P3 maintains the pressure chamber 23 in an expanded state for a time period of about (½)×Tc, for example. In this preferred embodiment, the third driving pulse P4 maintains the pressure chamber 23 in an expanded state for a time period of about (½)×Tc, for example. Thus, the ink injection is stabilized and a large ink drop is injected.

In this preferred embodiment, the timing ΔT1 at which the second driving pulse P2 starts is preferably set to about 1×Tc after the start of the first driving pulse P1. Namely, in m×Tc mentioned above, m is preferably set to m=1. In this preferred embodiment, the timing ΔT2 at which the third driving pulse P3 starts is preferably set to (2+(½))×Tc after the start of the second driving pulse P2. Namely, in (n+(½))×Tc mentioned above, n is preferably set to n=2, for example. In this preferred embodiment, the timing ΔT3 at which the fourth driving pulse P4 starts is preferably set to about 2×Tc after the start of the third driving pulse P3, for example. Namely, in p×Tc mentioned above, p is preferably set to p=2, for example. With such settings, the printing speed is increased to improve the throughput, and the ink drop is guaranteed to be injected at a sufficiently high speed to more stabilize the injection. In addition, the ink drops injected by the first through fourth driving pulses land at the same or substantially the same position on the recording paper sheet 5.

Preferred embodiments of the present invention are described above. The above-described preferred embodiments are merely examples, and the present invention is able to be carried out in any of various other preferred embodiments.

For example, in the above-described preferred embodiments, the pressure generator preferably is the piezoelectric element of the longitudinal vibration mode. The pressure generator is not limited to this. The pressure generator may be, for example, a magnetostrictive element. The piezoelectric element may be of a transverse vibration mode.

The charge/discharge time period of each driving pulse, and the value of potential reached by each driving pulse by discharge, preferably may be set to any value as long as the above-described settings are satisfied. For example, in the above-described preferred embodiment, the first through fourth driving pulses P1 through P4 are preferably set to be equal or substantially equal to each other in the discharge time period and the discharge maintaining time period. The first through fourth driving pulses P1 through P4 are not limited to this. In the above-described preferred embodiments, the potential V11 reached by the first driving pulse P1 by discharge is higher than the potential V12 reached by the second driving pulse P2 by discharge. Alternatively, the potentials V11 and V12 may be equal or substantially equal to each other. In the above-described preferred embodiment, the potential V13 reached by the third driving pulse P3 by discharge is higher than the potential V14 reached by the fourth driving pulse P4 by discharge. Alternatively, the potentials V13 and V14 may be equal or substantially equal to each other. In the above-described preferred embodiment, the second driving pulse P2 includes the waveforms T25 through T27 of the opposite phase to that of the Helmholtz characteristic vibration. The second driving pulse P2 does not need to include such waveforms.

In the above-described preferred embodiments, the liquid preferably is ink, for example. The liquid is not limited to this. The liquid may be, for example, a resin material, any of various liquid compositions containing a solute and a solvent (e.g., washing liquid), or the like.

In the above-described preferred embodiments, the liquid injection head preferably is the ink injection head 15 mountable on the inkjet recording device. The liquid injection head is not limited to this. The liquid injection head may be mountable on, for example, any of various production devices of an inkjet system, a measuring device such as a micropipette, or the like, to be usable in any of various uses.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid injection device, comprising:

a liquid injection head injecting a liquid drop; and a controller controlling the liquid injection head; wherein the liquid injection head includes:

a hollow case main body provided with an opening;

a vibration plate attached to the case main body to cover the opening, the vibration plate defining a pressure chamber together with the case main body;

a pressure generator coupled with the vibration plate and expanding and contracting the pressure chamber; and a nozzle in the case main body so as to be in communication with the pressure chamber, the nozzle allowing a liquid to flow out therefrom;

the controller includes:

a driving signal generator generating a driving signal including, in one liquid drop injection period, a first driving pulse to expand and contract the pressure chamber to inject a first liquid drop, a second driving pulse to expand and contract the pressure chamber to inject a second liquid drop; a third driving pulse to expand and contract the pressure chamber to inject a third liquid drop, and a fourth driving pulse to expand and contract the pressure chamber to inject a fourth liquid drop; and a driving signal supplier supplying the driving signal to the pressure generator of the liquid injection head; and Tc is a Helmholtz characteristic vibration period of the liquid injection head;

the first driving pulse maintains the pressure chamber in an expanded state for a time period of about (½)×Tc;

the second driving pulse starts at a timing that is about m×Tc after a start of the first driving pulse, m being an integer of 1 or greater, to maintain the pressure chamber in the expanded state for the time period of about (½)×Tc, and to inject the second liquid drop at a speed higher than, or equal to, a speed at which the first liquid drop is injected;

the third driving pulse starts at a timing that is about (n+(½))×Tc after a start of the second driving pulse, n being an integer of 1 or greater; and the fourth driving pulse starts at a timing that is about p×Tc after a start of the third driving pulse, p being an integer of 2 or greater, and to inject the fourth liquid drop at a speed higher than, or equal to, a speed at which the third liquid drop is injected.

2. The liquid injection device according to claim 1, wherein the first driving pulse includes:

a first potential decreasing waveform decreasing from an intermediate potential to a first minimum potential during a first time period; and a first minimum potential maintaining waveform maintained at the first minimum potential for a second time period;

the second driving pulse includes:

a second potential decreasing waveform decreasing from the intermediate potential to a second minimum potential during a third time period; and a second minimum potential maintaining waveform maintained at the second minimum potential for a fourth time period; wherein the first driving pulse results in a sum of the first time period and the second time period being equal to about (½)×Tc; and the second driving pulse results in a sum of the third time period and the fourth time period being equal to about (½)×Tc.

3. The liquid injection device according to claim 2, wherein an amount of potential change provided by the first driving pulse from the intermediate potential to the first minimum potential is ΔV1;

an amount of potential change provided by the second driving pulse from the intermediate potential to the second minimum potential is ΔV2; and ΔV1 and ΔV2 satisfy ΔV1≤ΔV2.

4. The liquid injection device according to claim 3, wherein the third driving pulse includes a third potential decreasing waveform decreasing from the intermediate potential to a third minimum potential during a fifth time period;

the fourth driving pulse includes a fourth potential decreasing waveform decreasing from the intermediate potential to a fourth minimum potential during a sixth time period;

an amount of potential change provided by the third driving pulse from the intermediate potential to the third minimum potential is ΔV3;

an amount of potential change provided by the fourth driving pulse from the intermediate potential to the fourth minimum potential is ΔV4; and ΔV3 and ΔV4 satisfy ΔV3≤ΔV4.

5. The liquid injection device according to claim 4, wherein ΔV1 and ΔV3 satisfy ΔV1<ΔV3≤1.3×Δv1.

6. The liquid injection device according to claim 1, wherein the fourth ink drop is injected at a speed higher than, or equal to, and at most about 1.2 times as high as, the speed at which the first ink drop is injected.

7. The liquid injection device according to claim 1, wherein the third driving pulse maintains the pressure chamber in an expanded state for a time period of about (½)×Tc.

8. The liquid injection device according to claim 1, wherein the fourth driving pulse maintains the pressure chamber in an expanded state for a time period of about (½)×Tc.

9. The liquid injection device according to claim 1, wherein m is 1.

10. The liquid injection device according to claim 1, wherein n is 2.

11. The liquid injection device according to claim 1, wherein p is 2.

12. An inkjet recording device, comprising the liquid injection device according to claim 1.

* * * * *